US005636607A

United States Patent [19]

Sattler et al.

[11] Patent Number: 5,636,607

[45] Date of Patent: Jun. 10, 1997

[54] PLASTIC VALVE COVER WITH INTEGRAL NOISE SHIELD

[75] Inventors: Eric R. Sattler; Joel S. Myers, both of Southgate, Mich.

[73] Assignee: BASF Corporation, Mount Olive, N.J.

[21] Appl. No.: 672,828

[22] Filed: Jun. 28, 1996

[51] Int. Cl.[6] ..... F02F 7/00

[52] U.S. Cl. ..... 123/195 C; 123/90.38

[58] Field of Search ..... 123/90.38, 195 C, 123/198 E

[56] References Cited

U.S. PATENT DOCUMENTS

| | | | |
|---|---|---|---|
| Re. 33,575 | 4/1991 | Ballheimer et al. | 123/198 E |
| 4,048,366 | 9/1977 | Kingsbury | 123/195 C |
| 4,213,440 | 7/1980 | Abe et al. | 123/195 C |
| 4,522,165 | 6/1985 | Ogawa | 123/195 C |
| 4,611,687 | 9/1986 | Nixon | 181/286 |
| 4,771,747 | 9/1988 | Ballheimer et al. | 123/198 E |
| 4,821,699 | 4/1989 | Mackin | 123/90.38 |
| 4,938,314 | 7/1990 | Sitzler et al. | 123/195 C |
| 4,951,783 | 8/1990 | Kamprath et al. | 123/195 C |
| 5,095,860 | 3/1992 | Newell | 123/195 C |
| 5,255,647 | 10/1993 | Kiczek | 123/195 C |
| 5,323,745 | 6/1994 | Sato et al. | 123/195 C |
| 5,365,901 | 11/1994 | Kiczek | 123/195 C |
| 5,375,569 | 12/1994 | Santella | 123/195 C |
| 5,452,693 | 9/1995 | Clark | 123/195 C |
| 5,511,518 | 4/1996 | Jain et al. | 123/195 C |

FOREIGN PATENT DOCUMENTS

| | | |
|---|---|---|
| 1306807 | 2/1973 | United Kingdom . |
| 1307868 | 2/1973 | United Kingdom . |
| 1400447 | 7/1975 | United Kingdom . |
| 1516150 | 6/1978 | United Kingdom . |

*Primary Examiner*—Noah P. Kamen

*Attorney, Agent, or Firm*—Harness, Dickey & Pierce, P.L.C.

[57] ABSTRACT

A plastic valve cover, having an inner shell for use with an internal combustion engine. The inner shell provides a first noise shield while the valve cover body and a cap define a second noise shield.

24 Claims, 3 Drawing Sheets

PLASTIC VALVE COVER WITH INTEGRAL NOISE SHIELD

FIELD OF THE INVENTION

The present invention relates to valve covers for use with internal combustion engines, and more particularly, to a plastic valve cover with an integral noise shield.

BACKGROUND AND SUMMARY OF THE INVENTION

A substantial amount of noise in an engine is generated by the valve train, especially in an overhead-cam engine. Valve trains as the term is used herein, generally include the intake and exhaust valves as well as the apparatus for operating the valves including rocker arms, cams and valve springs. Generally, valve covers are a simple, open-ended box which bolts to the cylinder head. To seal against oil leaks around the open end of the box gaskets are often employed.

The conventional valve covers are made of metal or thermoset plastics having a simple shell shape. A perceived problem with conventional valve train covers is that they fail to provide sufficient noise insulating properties. Accordingly, it is desirable in the art of valve cover design to provide a valve cover with a noise shield for quieting the noise emitted from the valve train of an internal combustion engine.

It is further desirable to provide a valve train cover that is lighter than conventional steel or aluminum valve train covers.

It is also desirable to provide a valve train cover which reduces the need for an external noise shield on an engine or within an engine compartment.

The present invention therefore provides a plastic valve cover, for use with an internal combustion engine, having an integral noise shield.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only and thus are not limitative of the present invention, and wherein.

DETAILED DESCRIPTION OF THE PREFERRED EMBODIMENTS

Figure 1:
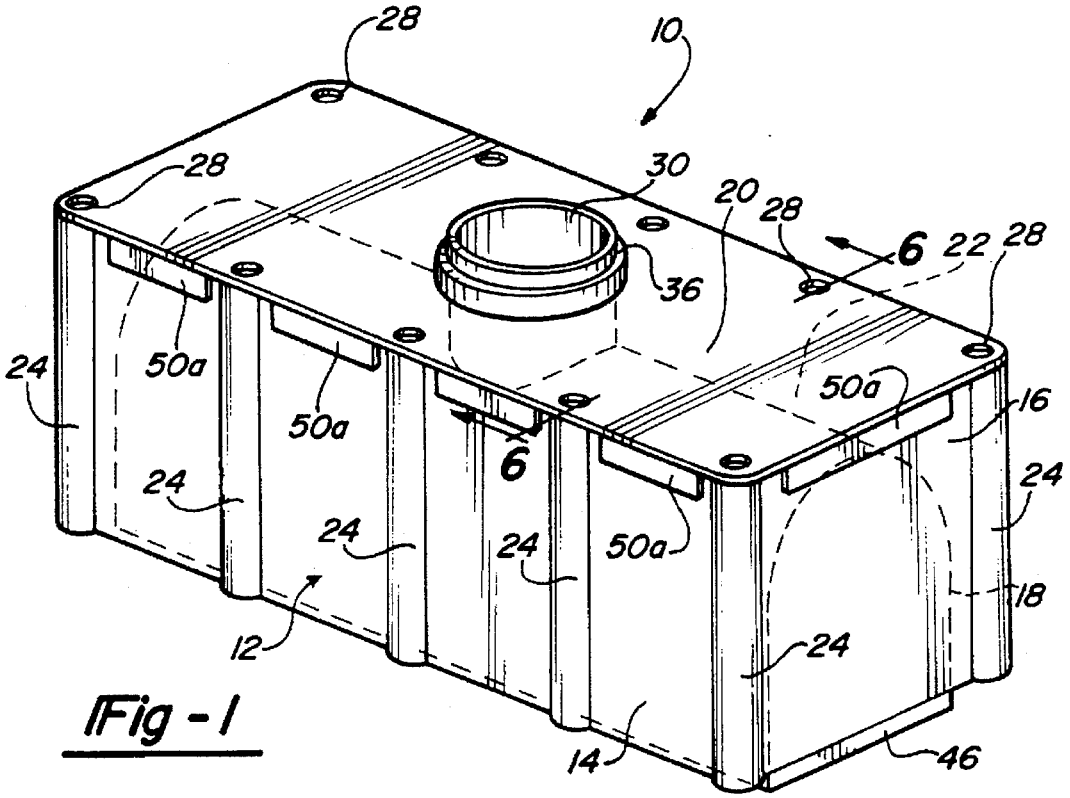
FIG. 1 is a perspective view of a plastic valve cover with integral noise shield according to the principles of the present invention.

The present invention will be described with reference to FIGS. 1–6 which illustrate a preferred embodiment of the present invention. In FIG. 1, a valve cover 10 is illustrated including a valve cover body 12 having a pair of sidewalls 14 connected to one another by a pair of end walls 16. An inner shell portion 18 (shown in phantom) is disposed within valve cover body 12 for providing a first noise shield for the valve cover 10. A cap member 20 is provided for engaging with an upper surface **14*a*, 16*a*, respectively, of walls 14, 16. An enclosed space 22 is defined between inner shell portion 18 and cap member 20. Furthermore, cap member 20 along with sidewalls 14 and end walls 16** define a second noise shield.

Valve cover body 12 is provided with a plurality of bosses 24 each having a bolt hole 26 therethrough, and cap member 20 is provided with a plurality of bolt holes 28 corresponding to bosses 24 such that a plurality of bolts (not shown) can be inserted through bolt holes 26 and 28 for securely fastening valve cover 10 to an internal combustion engine. A press fit cover can also be used with the present invention.

Figure 2:
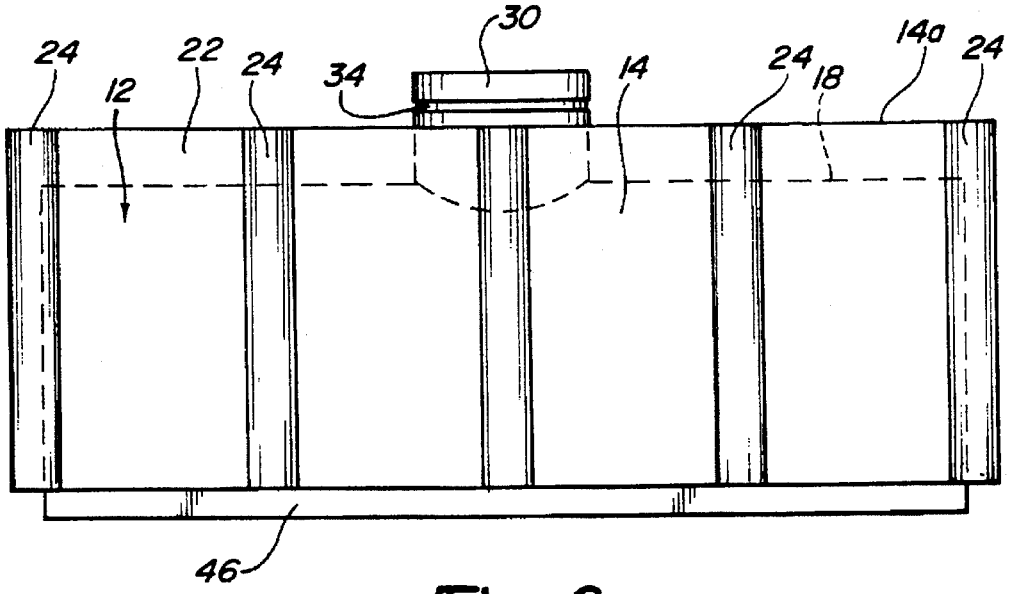
FIG. 2 is a side view of a valve cover body according to the principles of the present invention.
Figure 3:
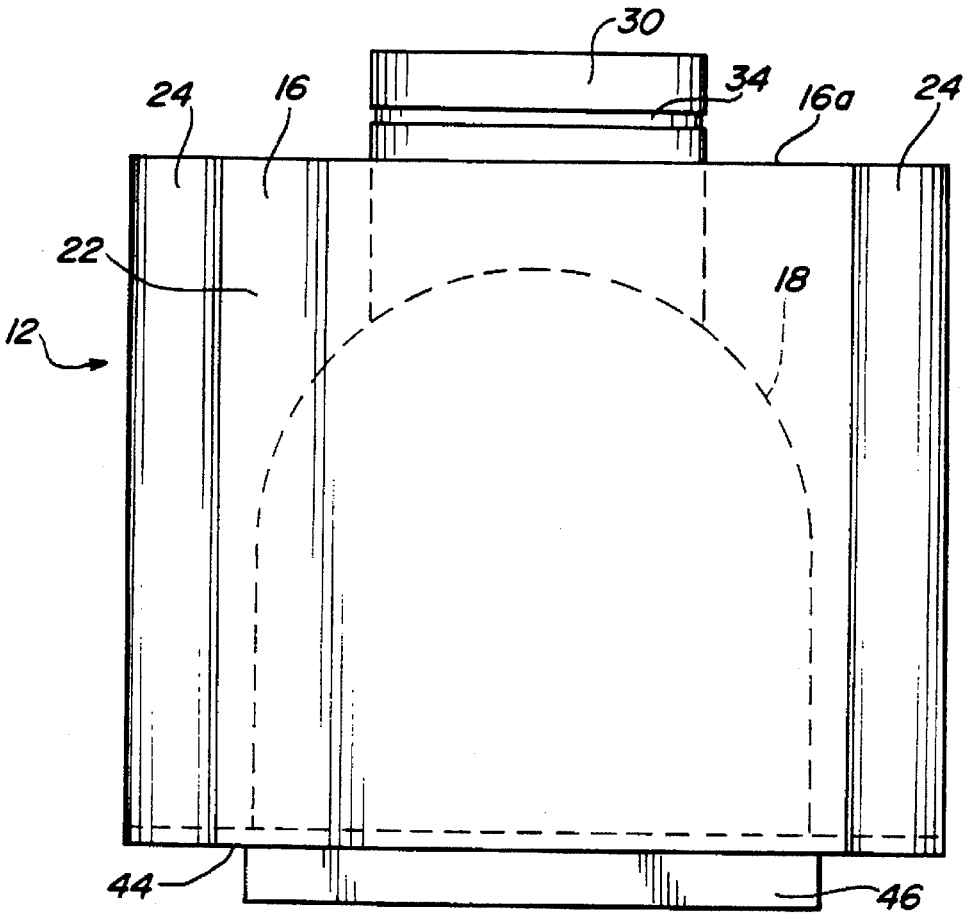
FIG. 3 is an end view of a valve cover body according to the principles of the present invention.

With reference to FIGS. 1–3, inner shell 18 is provided with an oil spout 30. It should be noted that in a typical V-type engine, separate valve covers are provided for the valve trains on each side of the engine. However, only one of the valve covers is typically provided with an oil spout for the introduction of oil into the engine. Therefore, although the drawings of the instant application illustrate an oil spout 30 in a valve cover 10, it should be understood that the valve cover design of the present invention should not be construed as limited to having an oil spout for certain embodiments.

Oil spout 30 is integrally molded with inner shell 18. Oil spout 30 projects up through a corresponding opening 32 in cap 20. A groove 34 is provided around a periphery of oil spout 30. Groove 34 is designed to receive a sealing gasket (not shown) which is designed to prevent intrusion of foreign materials into the space provided between inner shell 18 and cap 20. Cap 20 is provided with an annular ring 36 around opening 32 in order to provide a sealed relationship along with the gasket provided in groove 34 of oil spout 30.

Figure 6:
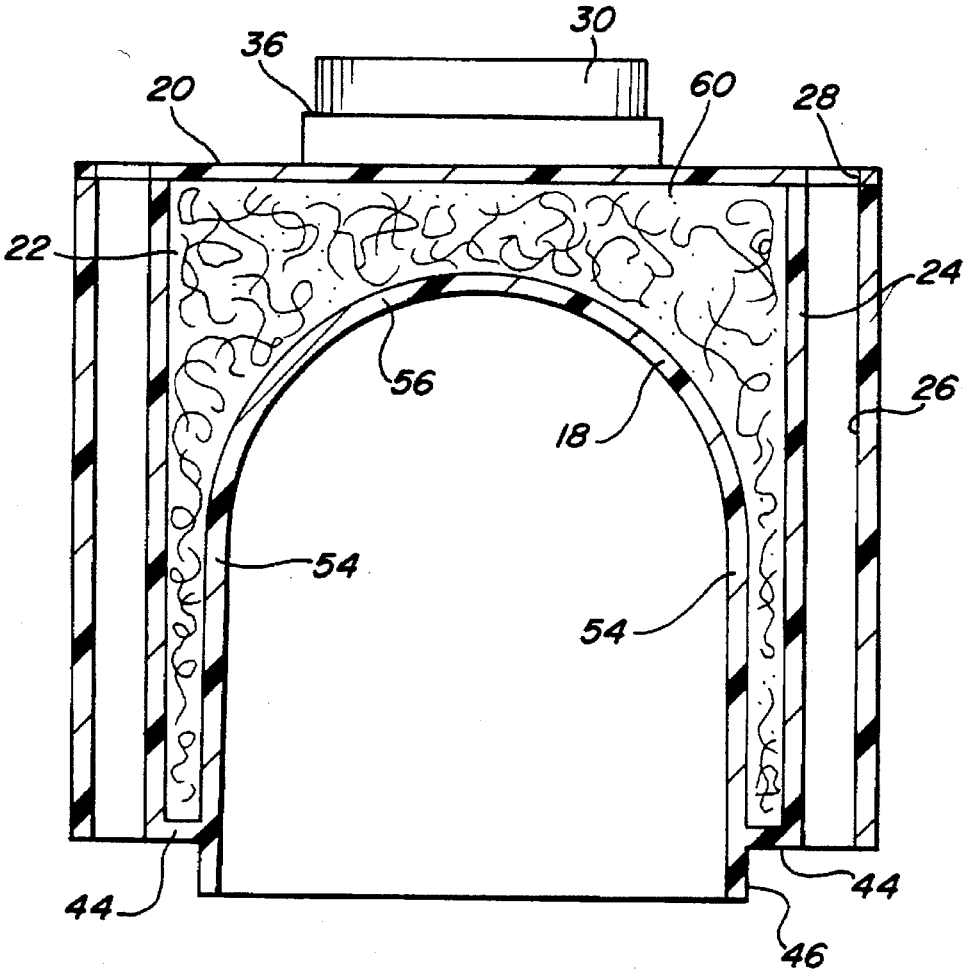
FIG. 6 is a cross-sectional view of the valve cover according to the principles of the present invention taken along line 6—6 of FIG. 1.

Valve cover body 12 is provided with a base portion 44, as shown in FIG. 6, which connects with inner shell 18. According to a preferred embodiment of the present invention, valve cover body 12 and inner shell 18 are formed as a unitary member from an engineering plastic material. A sealing lip portion 46 extends beneath base portion 44, as shown in FIG. 6, and is designed to lie on the inside of a flange of a cylinder head.

Figure 4:
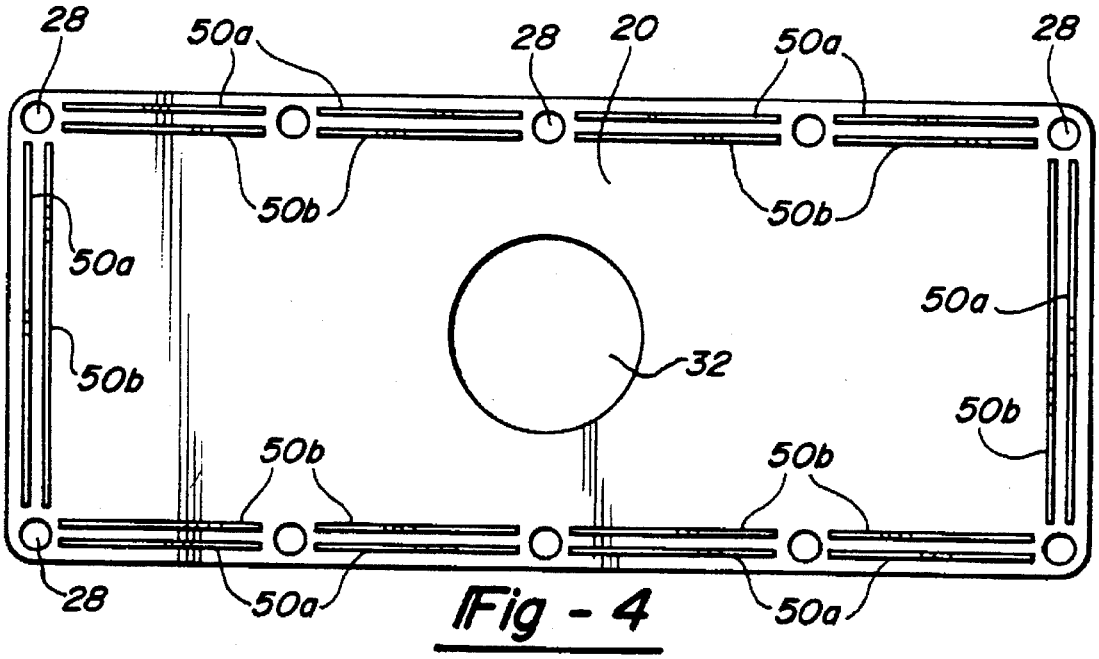
FIG. 4 is a bottom view of a cap member for covering said valve cover body according to the principles of the present invention.
Figure 5:
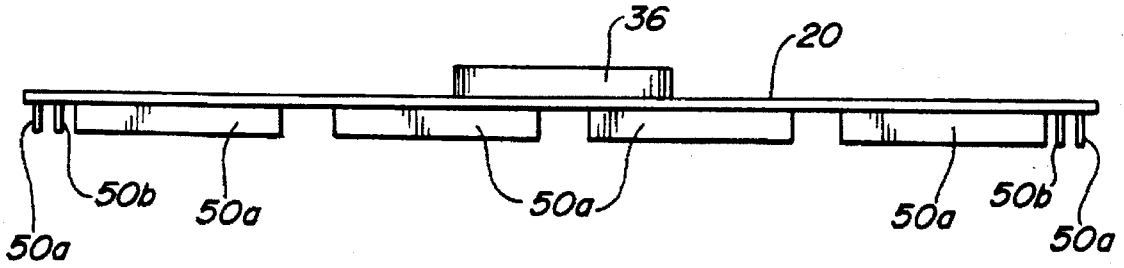
FIG. 5 is a side view of a cap member for covering said valve cover body according to the principles of the present invention.

As shown in FIGS. 4 and 5, cap 20 is provided with a plurality of guide flanges **50*a*, 50*b* which facilitate the placement of cap 20 on valve cover body 12. Outer flange members 50*a* are disposed on an outward side of walls 14, 16 of valve cover body 12, as shown in FIG. 1. Inner guide flanges 50*b* are provided to be disposed on an inward side of walls 14, 16 of valve cover body 12. A gasket or other sealing means may be disposed between cap 20 and valve cover body 12**.

With reference to FIG. 6, a cross-sectional view of valve cover 10 is shown taken along line 6—6 of FIG. 1. As should be apparent from FIG. 6, inner shell 18 is connected to valve cover body 12 by base portion 44. The inner shell 18 and valve cover body 12 are formed as a unitary member. Inner shell 18 is provided with a pair of sidewalls 54 which are connected to one another by arcuate upper wall 56. It should be understood by the skilled artisan that inner shell 18 can be provided with alternative shapes without departing from the scope of the present invention. Insulating filler material 60 may be provided in the enclosed space 22 between inner shell 18 and sidewalls 14 as well as between inner shell 18 and cap 20. The cross-sectional view of FIG. 6 is taken through bosses 24 provided in sidewalls 14 of valve cover body 12. As stated previously, Bosses 24 each define bolt hole 26 which corresponds with bolt holes 28 in cap 20.

As previously noted, valve cover body 12 is preferably formed as a unitary member with inner shell 18. Valve body cover 12 and inner shell 18 are preferably formed of an engineering plastic material having suitable performance properties such as desirable heat stability and dimensional stability and utilizing conventional plastic molding techniques such as injection molding, for example. Illustrative materials are nylon (polyamide), a polybutylene terephthalate (PBT) or a PBT and acrylonitrile styrene acrylate (ASA) blend, ABS polymer (acrylonitrile-butadiene-styrene), and polycarbonate. Such materials may also be reinforced with glass and/or mineral fibers or particles. Especially preferred materials are ULTRAMID® A3HG7 Blk Q17 20560 nylon, ULTRAMID® A3WG7 Blk 23210 nylon, ULTRAMID® B3WG7 Blk 564 BGVW nylon and ULTRAMID® B3GM35 nylon, commercially from BASF Corporation of Wyandotte, Mich.

The insulating filler material 60 provided between inner shell 18 and cap 20 can be any known noise insulating material such as foams, silicates, fluids, fibers, and organic by-products such as walnut shells. While it is often preferable to employ a noise insulating material is the space 22 between inner shell 18 and cap 20 it should be understood that the space can remain empty.

It should be noted that bosses 24 are provided for increasing the stiffness of valve cover body 12. A problem with direct conversion of conventional steel or aluminum valve cover designs into plastic material is that the plastic material has a reduced stiffness in comparison to the steel or aluminum. Thus, the bosses 24 provide adequate stiffness for securing valve cover 10 to an engine valve train for preventing leaks between the valve cover 10 and the engine valve train. Further the sealing lip portion 46 is provided for preventing oil leakage. As noted, a gasket (not shown) may be used between walls 14, 16 of valve cover 10 and the engine valve train.

The inner shell 18 provides a first noise shield for the noise generated by the engine valve train. The valve cover body 12 combines with cap 20 to provide a second noise shield for the noise generated by the engine valve train. Noise insulating material is also optionally provided between the first and second noise shields for further reducing the noise emitted from the engine valve train.

The invention being thus described, it should be understood that the same may be varied in many ways. Such variations are not to be regarded as a departure from the spirit and scope of the invention, but rather all such modifications are intended to be included within the scope of the following claims.

What is claimed is:

1. A valve cover, comprising:

a valve cover body having a pair of side walls and a pair of end walls connected between said sidewalls, said side and end walls being provided with a bottom surface for engaging with an engine and a top surface opposite said bottom surface;

a cap extending between said top surfaces of said side and end walls; and an inner shell extending between said side walls for defining a space between said inner shell and said cap.

2. The valve cover according to claim 1, wherein said valve cover is made from a plastic material.

3. The valve cover according to claim 1, further comprising insulating material disposed between said inner shell and said cap.

4. The valve cover according to claim 1, wherein said valve cover body is provided with a plurality of bosses having bolt holes therethrough.

5. The valve cover according to claim 4, wherein said cap is provided with a plurality of bolt holes corresponding to said bolt holes in said bosses.

6. The valve cover according to claim 1, wherein said cap is provided with a plurality of guide flanges on a surface thereof for engaging with said sidewalls and said end walls of said valve cover body.

7. The valve cover according to claim 1, wherein said inner shell is formed as a unitary member with said valve cover body.

8. The valve cover according to claim 7, wherein said valve body and said inner shell are connected to one another by a base portion.

9. The valve cover according to claim 8, wherein said base portion is provided with a lip portion extending therefrom.

10. The valve cover according to claim 1, further comprising an oil spout connected to said inner shell.

11. The valve cover according to claim 10, wherein said cap is provided with an opening for receiving said oil spout.

12. A valve cover for use with an internal combustion engine, comprising:

a valve cover body including a plurality of walls each having a top surface;

a cap extending between said top surfaces of said plurality of walls; and an inner shell extending between said plurality of walls for defining an enclosed space between said inner shell and said cap.

13. The valve cover according to claim 12, wherein said valve cover is made from a plastic material.

14. The valve cover according to claim 12, further comprising insulating material disposed between said inner shell and said cap.

15. The valve cover according to claim 14, wherein said cap is provided with a plurality of bolt holes corresponding to said bolt holes in said bosses.

16. The valve cover according to claim 12, wherein said valve cover body is provided with a plurality of bosses having bolt holes therethrough.

17. The valve cover according to claim 12, wherein said cap is provided with a plurality of guide flanges on a surface thereof for engaging said sidewalls and said end walls of said valve cover body.

18. The valve cover according to claim 12, wherein said inner shell is formed as a unitary member with said valve cover body.

19. The valve cover according to claim 18, wherein said valve cover body and said inner shell are connected to one another by a base portion.

20. The valve cover according to claim 19, wherein said base portion is provided with a lip portion extending therefrom.

21. The valve cover according to claim 12, further comprising an oil spout connected to said inner shell.

22. The valve cover according to claim 21, wherein said cap is provided with an opening for receiving said oil spout.

23. A valve cover for use with an internal combustion engine, comprising:

a first noise shield for covering a valve train of said internal combustion engine;

a second noise shield spaced apart from said first noise shield and defining an enclosed space between said first and second noise shields; and means for fastening said valve cover to said internal combustion engine including a plurality of elongated bosses generally extending from a bottom portion to an uppermost portion of said valve cover;

wherein said first and second noise shields are formed from an engineering plastic material.

24. The valve cover according to claim 23, further comprising noise insulating material disposed between said first and second noise shields.

* * * * *